US012173942B2

(12) United States Patent
Cluff et al.

(10) Patent No.: US 12,173,942 B2
(45) Date of Patent: Dec. 24, 2024

(54) METHOD OF OPERATING A HEAT PUMP SYSTEM

(71) Applicants: Charles Cluff, Zionsville, IN (US); Derek Leman, Brownsburg, IN (US)

(72) Inventors: Charles Cluff, Zionsville, IN (US); Derek Leman, Brownsburg, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 260 days.

(21) Appl. No.: 17/810,011

(22) Filed: Jun. 30, 2022

(65) Prior Publication Data

US 2023/0064936 A1 Mar. 2, 2023

Related U.S. Application Data

(60) Provisional application No. 63/260,582, filed on Aug. 26, 2021.

(51) Int. Cl.
*F25B 49/02* (2006.01)
*F25B 30/02* (2006.01)
*F25B 40/06* (2006.01)

(52) U.S. Cl.
CPC ..... *F25B 49/02* (2013.01); *F25B 30/02* (2013.01); *F25B 40/06* (2013.01); *F25B 2500/23* (2013.01); *F25B 2600/2513* (2013.01); *F25B 2700/21151* (2013.01)

(58) Field of Classification Search
CPC ..... F25B 49/02; F25B 2600/2513; F25B 2500/23; F25B 40/06; F25B 30/02; F25B 2700/21151
See application file for complete search history.

(56) References Cited

U.S. PATENT DOCUMENTS 2,807,943 A 10/1957 Lynch et al.
3,006,155 A 10/1961 Vanderlee et al.
4,236,381 A 12/1980 Imral et al.
4,796,436 A 1/1989 Voorhis et al.
5,136,855 A 8/1992 Lenarduzzi
5,140,827 A 8/1992 Reedy
5,251,453 A * 10/1993 Stanke ..... B60H 1/00978 62/133
5,301,514 A * 4/1994 Bessler ..... G01F 23/22 62/126

(Continued)

*Primary Examiner* — Henry T Crenshaw
(74) *Attorney, Agent, or Firm* — Souad Hakim

(57) ABSTRACT

A method of operating a heat pump system comprising: operating the heat pump system in a demand operation heating mode, wherein the demand operation heating mode comprises controlling an opening amount of an expansion valve based on a superheat difference between a compressor inlet superheat value and a target compressor inlet superheat value, and controlling a flowrate of the refrigerant through a compressor based on a thermal demand difference between a thermal output of the indoor heat exchanger and a customer thermal demand; monitoring with the one or more controllers a parameter of the refrigerant cycle indicative of a charge imbalance condition; and transitioning operation with the one or more controllers to a charge compensation mode when the parameter satisfies a first threshold condition, wherein the charge compensation mode comprises performing with the one or more controllers a charge imbalance mitigation strategy.

19 Claims, 5 Drawing Sheets

(56) References Cited

U.S. PATENT DOCUMENTS

| | | | | |
|---|---|---|---|---|
| 5,784,892 | A | 7/1998 | Reedy | |
| 5,937,670 | A | 8/1999 | Derryberry | |
| 8,056,348 | B2 | 11/2011 | Murakami et al. | |
| 8,756,943 | B2 | 6/2014 | Chen et al. | |
| 9,163,866 | B2 | 10/2015 | Buckley et al. | |
| 9,765,979 | B2 | 9/2017 | Alsaleem et al. | |
| 9,874,384 | B2 | 1/2018 | Connell et al. | |
| 10,168,087 | B2 | 1/2019 | Munk et al. | |
| 2010/0236283 | A1* | 9/2010 | Ballet | F25B 43/003 96/113 |
| 2017/0016659 | A1 | 1/2017 | Chen et al. | |
| 2017/0363337 | A1* | 12/2017 | Swofford | F25B 49/02 |
| 2018/0340719 | A1* | 11/2018 | Rona | F25B 31/008 |
| 2020/0158370 | A1 | 5/2020 | Lu et al. | |
| 2020/0200458 | A1* | 6/2020 | Assouad | F25B 49/005 |

* cited by examiner

METHOD OF OPERATING A HEAT PUMP SYSTEM

CROSS REFERENCE TO A RELATED APPLICATION

The application claims the benefit of U.S. Provisional Application No. 63/260,582 filed Aug. 26, 2021, the contents of which are hereby incorporated in their entirety.

FIELD OF THE INVENTION

Exemplary embodiments pertain to the art of heating, ventilation, air conditioning, or refrigeration (HVAC/R) systems. More particularly, the present disclosure relates to methods of operation of heat pump systems.

BACKGROUND

Heat pump systems can have larger outdoor heat exchangers in comparison to the indoor heat exchangers. The size difference can be attributed to various factors. For example, in high efficiency systems, large outdoor heat exchangers enable higher system efficiencies for a relatively low system cost and can be utilized by heat pump manufacturers to support higher tier offerings. In another example, in retrofit applications, where new indoor or outdoor heat exchangers are paired with an existing system a heat exchanger volume mismatch can occur. In yet another example, exacting spatial constraints can be placed on the indoor heat exchanger while the spatial constraints on the outdoor heat exchangers can be more relaxed which can contribute to volume mismatch between the heat exchangers. Such disparity in heat exchanger volume can cause a charge imbalance when the system operates in heating mode resulting a buildup of charge in the indoor heat exchanger. Left unmitigated the imbalance in refrigerant charge can cause the heat pump system to shut down or operate at reduced capacity. Accordingly, in at least addressing this shortcoming of heat pump operational methods the following method of operating a heat pump system is disclosed.

BRIEF DESCRIPTION

Disclosed is a method of operating a heat pump system comprising operating the heat pump system in a demand operation heating mode with one or more controllers wherein a refrigerant flows through a refrigerant cycle from a compressor through an indoor heat exchanger, an expansion valve, and an outdoor heat exchanger before returning to the compressor, and wherein the demand operation heating mode comprises controlling with the one or more controllers an opening amount of the expansion valve based on a superheat difference between a compressor inlet superheat value and a target compressor inlet superheat value, and controlling with the one or more controllers a flowrate of the refrigerant through the compressor based on a thermal demand difference between a thermal output of the indoor heat exchanger and a customer thermal demand; monitoring with the one or more controllers a parameter of the refrigerant cycle indicative of a charge imbalance condition; and transitioning operation with the one or more controllers to a charge compensation mode when the parameter satisfies a first threshold condition, wherein the charge compensation mode comprises performing with the one or more controllers a charge imbalance mitigation strategy.

In addition to one or more of the above disclosed aspects or as an alternate wherein the performing with the one or more controllers the charge imbalance mitigation strategy further comprises: operating the heat pump system in a mitigation mode comprising performing a mitigation comprising at least one of an expansion valve mitigation, or a compressor mitigation and further comprising decreasing with the one or more controllers a target value of the parameter from an enable value of the parameter to a disable value of the parameter; transitioning operation with the one or more controllers from the mitigation mode to a recovery mode when the parameter satisfies a second threshold condition; operating the heat pump system in the recovery mode comprising performing a recovery comprising at least one of a compressor inlet superheat recovery or a compressor flowrate recovery following the mitigation; and transitioning operation with the one or more controllers to the demand operation heating mode when the parameter satisfies a third threshold condition.

In addition to one or more of the above disclosed aspects or as an alternate further comprising: transitioning operation with the one or more controllers from the recovery mode to the mitigation mode when the parameter satisfies a fourth threshold condition.

In addition to one or more of the above disclosed aspects or as an alternate wherein the expansion valve mitigation comprises: stopping the controlling with the one or more controllers the opening amount of the expansion valve based on the superheat difference between the compressor inlet superheat value and the target compressor inlet superheat value; and controlling with the one or more controllers the opening amount of the expansion valve based on a difference between the parameter and the target value of the parameter.

In addition to one or more of the above disclosed aspects or as an alternate wherein the compressor mitigation comprises: stopping the controlling with the one or more controllers the flowrate of the refrigerant through the compressor based on the thermal demand difference between the thermal output of the indoor heat exchanger and the customer thermal demand; maintaining the opening amount of the expansion valve; and controlling with the one or more controllers the flowrate of the refrigerant through the compressor based on the difference between the parameter and the target value of the parameter.

In addition to one or more of the above disclosed aspects or as an alternate wherein the compressor inlet superheat recovery comprises: stopping the controlling with the one or more controllers the flowrate of refrigerant through the compressor based on the difference between the parameter and the target value of the parameter; maintaining a substantially constant flowrate of the refrigerant through the compressor; and controlling with the one or more controllers the opening amount of the expansion valve based on a superheat difference between a compressor inlet superheat value and a target compressor inlet superheat value.

In addition to one or more of the above disclosed aspects or as an alternate wherein the compressor flowrate recovery comprises: increasing with the one or more controllers the flowrate of the refrigerant through the compressor until the flowrate reaches a target flowrate value.

In addition to one or more of the above disclosed aspects or as an alternate further comprising: transitioning operation with the one or more controllers from the expansion valve mitigation to the compressor mitigation when the opening position of the expansion valve reaches a fully open position.

In addition to one or more of the above disclosed aspects or as an alternate further comprising: transitioning operation with the one or more controllers from the compressor mitigation to the expansion valve mitigation when the flowrate of refrigerant through the compressor reaches a minimum flowrate value.

In addition to one or more of the above disclosed aspects or as an alternate further comprising: transitioning operation with the one or more controllers from the mitigation mode to the compressor inlet superheat recovery when the parameter reaches the target value of the parameter.

In addition to one or more of the above disclosed aspects or as an alternate further comprising: transitioning operation with the one or more controllers from the mitigation mode to the compressor flowrate recovery when the parameter reaches the target value of the parameter.

In addition to one or more of the above disclosed aspects or as an alternate further comprising: transitioning operation with the one or more controllers from the compressor inlet superheat recovery to the compressor flowrate recovery when the compressor inlet superheat value reaches the target compressor inlet superheat value.

In addition to one or more of the above disclosed aspects or as an alternate further comprising: transitioning operation with the one or more controllers from the compressor flowrate recovery to the compressor inlet superheat recovery when the compressor speed reaches a full speed threshold.

In addition to one or more of the above disclosed aspects or as an alternate further comprising: transitioning operation with the one or more controllers from the recovery mode to the expansion valve mitigation when the parameter satisfies the first threshold condition.

In addition to one or more of the above disclosed aspects or as an alternate further comprising: transitioning operation with the one or more controllers from the recovery mode to the compressor mitigation when the parameter satisfies the first threshold condition.

In addition to one or more of the above disclosed aspects or as an alternate further comprising: transitioning operation with the one or more controllers from the expansion valve mitigation to the recovery mode when the parameter satisfies the second threshold condition.

In addition to one or more of the above disclosed aspects or as an alternate further comprising: transitioning operation with the one or more controllers from the compressor flowrate mitigation to the recovery mode when the parameter satisfies the second threshold condition.

In addition to one or more of the above disclosed aspects or as an alternate further comprising: transitioning operation with the one or more controllers from the compressor inlet superheat recovery to the mitigation mode when the parameter satisfies the first threshold condition.

In addition to one or more of the above disclosed aspects or as an alternate further comprising: transitioning operation with the one or more controllers from the compressor flowrate recovery to the mitigation mode when the parameter satisfies the first threshold condition.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
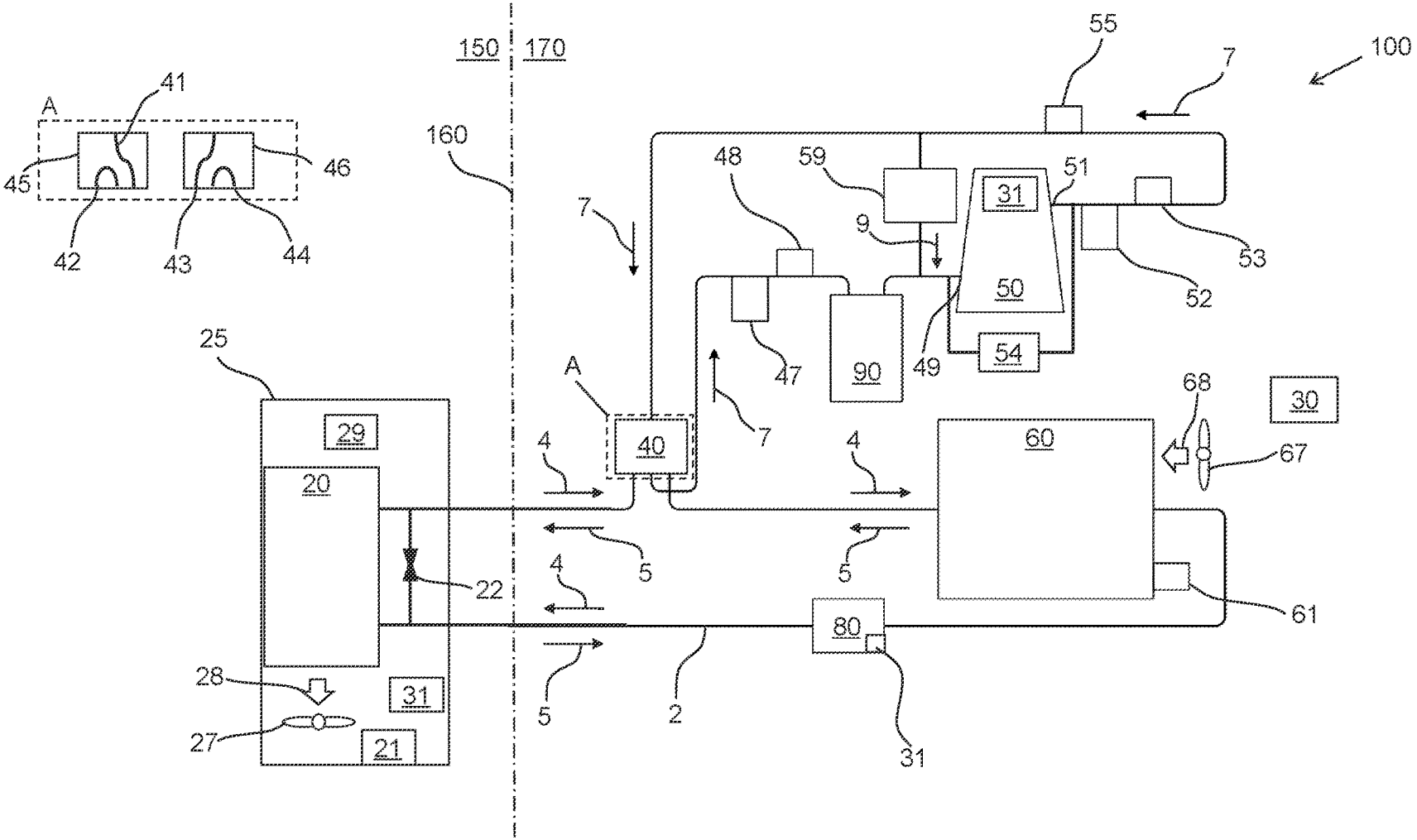
FIG. 1 is a schematic view of a heat pump system.
Figure 2:
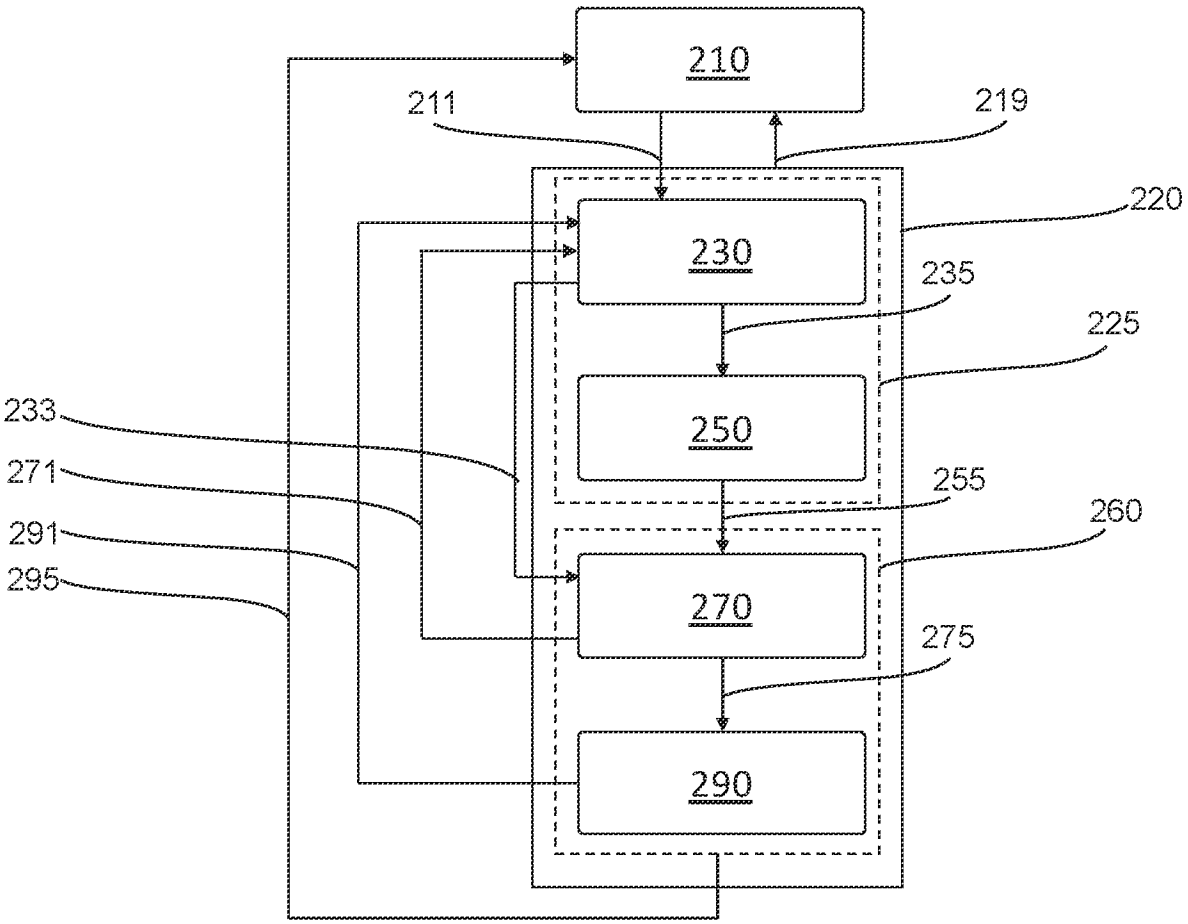
FIG. 2 is a schematic illustration of a first embodiment of a method of operating the heat pump system.
Figure 3:
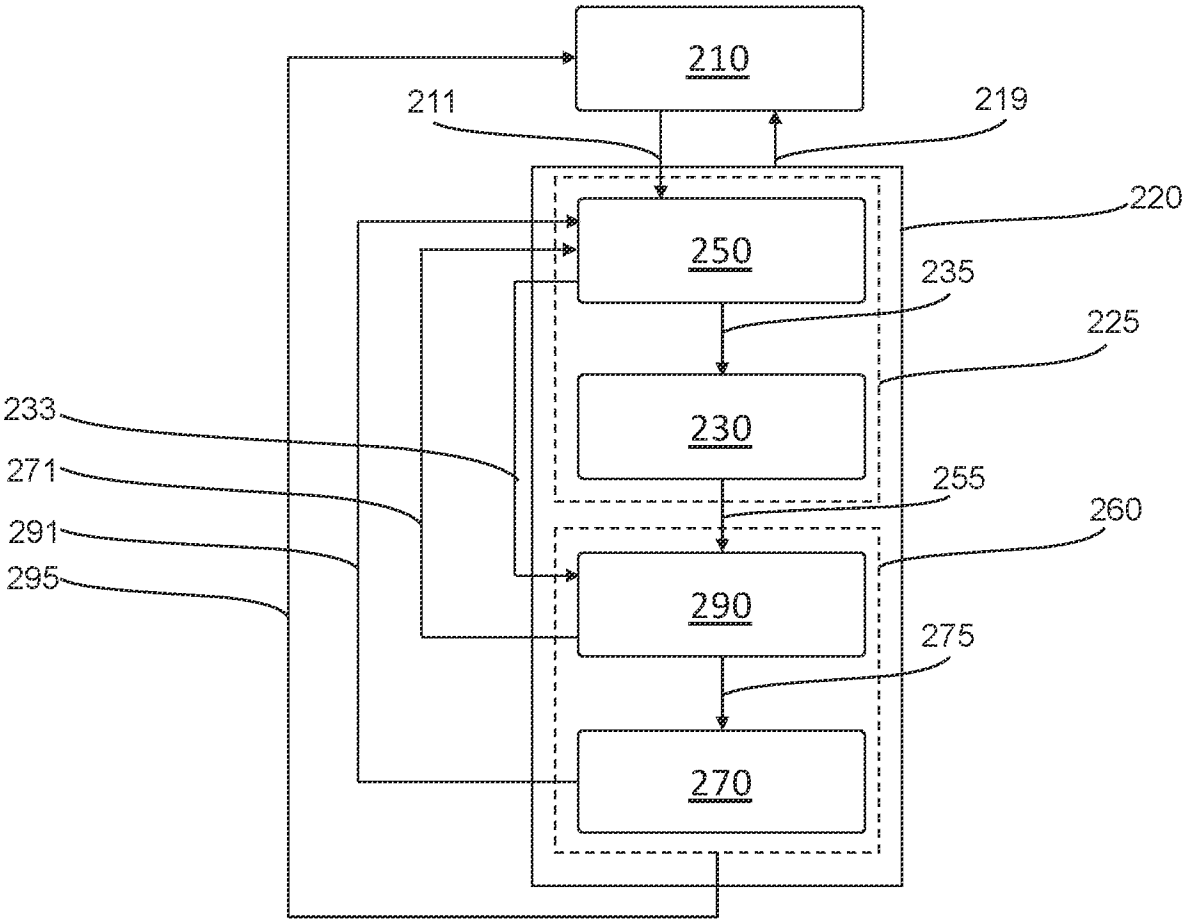
FIG. 3 is a schematic illustration of a second embodiment of the method of operating the heat pump system.
Figure 4:
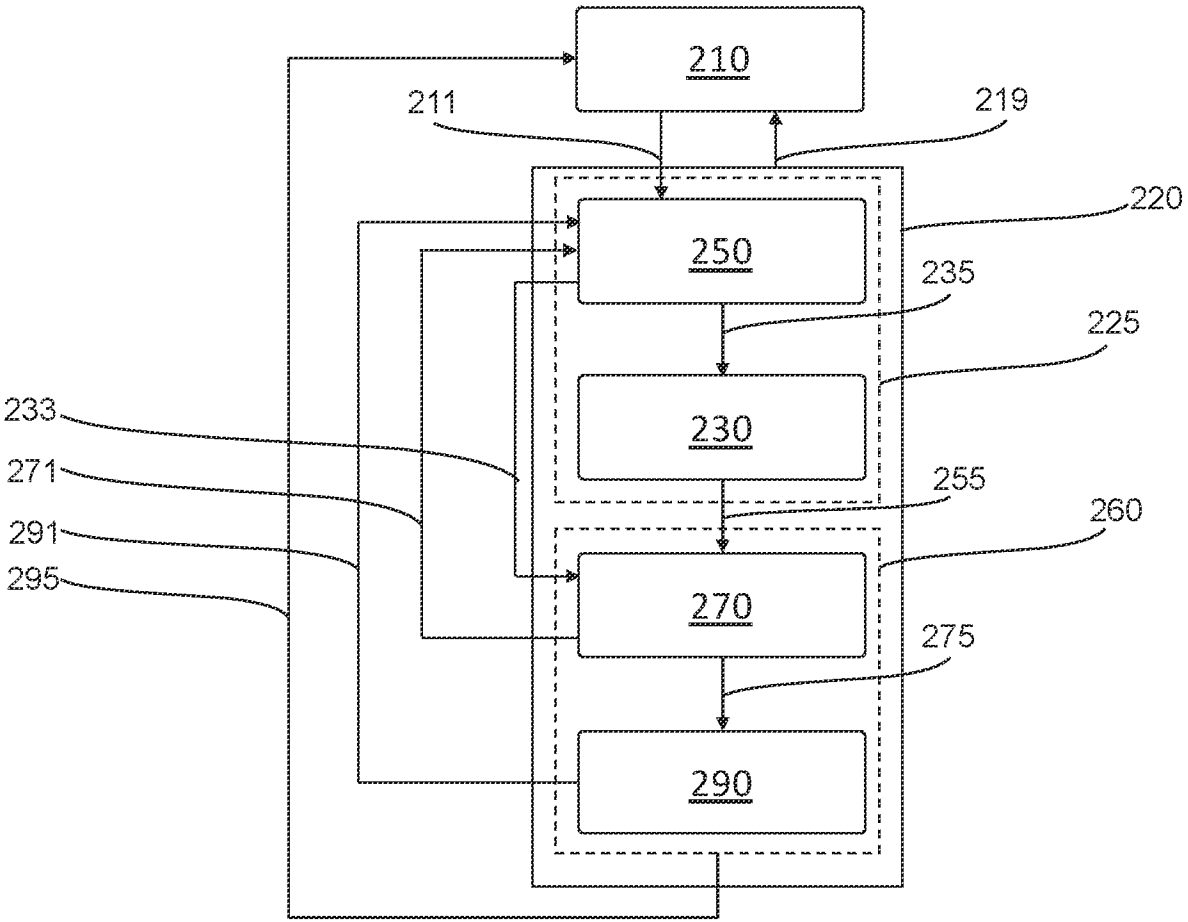
FIG. 4 is a schematic illustration of a third embodiment of the method of operating the heat pump system.
Figure 5:
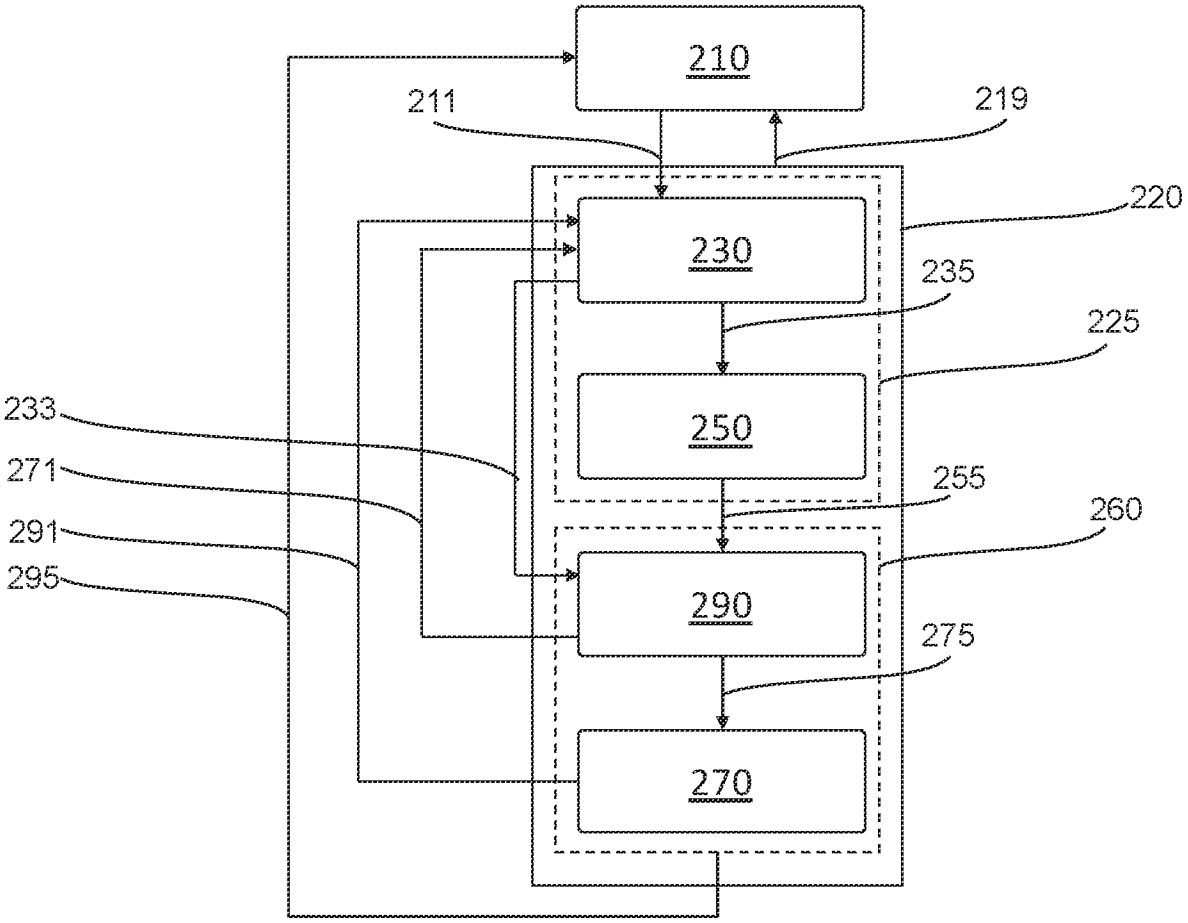
FIG. 5 is a schematic illustration of a fourth embodiment of the method of operating the heat pump system.

FIG. 1 is a schematic illustration of a heat pump system 100 having a closed fluid circuit 2 forming a refrigerant cycle containing a refrigerant fluid and including a compressor 50, a four-way valve 40, an indoor heat exchanger 20, an expansion valve 80 and an outdoor heat exchanger 60. The fluid circuit 2 can extend across a boundary 160 such that a portion of the circuit fluid circuit 2 is disposed indoors 150 and the remaining portion is disposed outdoors 170. The indoor heat exchanger 20 can be configured in operative communication with an air handling unit 25 (e.g., having an indoor fan or blower 27 for urging an indoor airflow 28 across the indoor heat exchanger 20).

The heat pump system 100 can include a system control function. The system control function can be carried out in various functionally equivalent architectures. For example, all of the control functions described herein can be centralized within one or more system controllers 30, portions of the control functions can be distributed among one or more distributed controllers 31, or a hybrid approach combining one or more system controllers 30 and one or more distributed controllers 31 can be utilized. The one or more system controllers 30 and/or distributed controllers 31 can be configured to communicate and/or interoperate such that the complete system control function can be performed in a coordinated fashion.

The one or more controllers 30, 31 can include a processor (e.g., such as a central processing unit (CPU), programmable gate array (FPGA), application specific integrated circuit (ASIC), or the like), memory for storing data, an input module, an output module, a communications module (e.g., wireless or wired), or a combination including at least one of the foregoing. The input and output modules can be configured for reading one or more sensor measurements (e.g., refrigerant temperature, refrigerant pressure, refrigerant flow rate, compressor speed, customer thermal demand, and the like), communicating one or more control commands to one or more components of the heat pump system 100, communicating with a user interface (e.g., thermostat) of the heat pump system 100, or a combination including at least one of the foregoing. The communications module can be configured for communicating coordination information between two or more controllers 30, 31 such as to execute the system control function disclosed herein.

In a centralized control architecture, the one or more system controllers 30 can be disposed in operable communication with components of the system and configured to manage the operation of the heat pump system 100 (e.g., in response to a customer thermal demand corresponding to a thermostat set point such as temperature, humidity, combination thereof, or the like). For example, the one or more system controllers 30 can be disposed in operable communication with, and configured to control, the expansion valve 80, the compressor 50, the air handler 25, the four-way valve 40, a pressure equalization valve 59, an indoor heat exchanger bypass valve 22, indoor fan or blower 27, outdoor fan or blower 67, other operable components of the heat pump system 100 (e.g. louver, thermostat, user interface, and the like), or a combination including at least one of the foregoing. In this way, the one or more system controllers 30 can drive output commands directly to system components to control the operation of the heat pump system 100.

Alternatively, in a fully distributed control architecture, a plurality of distributed controllers 31 can control individual components of the heat pump system 100. Communications between the distributed controllers 31 can support carrying out the system control function in a cooperative manner. For example, each of the plurality of distributed controllers 31 can be disposed in operative communication with, and configured to control, one of the compressor 50, the air handler 25, the expansion valve 80, the four-way valve 40, a pressure equalization valve 59, an indoor heat exchanger bypass valve 22, indoor fan or blower 27, outdoor fan or blower 67, or other operable components of the heat pump system 100 (e.g. louver, thermostat, user interface, and the like). The plurality of distributed controllers 31 can communicate to each other (e.g., over air broadcast, or signal via wired conductor) to coordinate control of the heat pump system 100.

Optionally, a hybrid control architecture combining aspects of centralized control and distributed control can be implemented. In a hybrid architecture some control functions can be centralized in one or more system controllers 30 while one or more distributed controllers 31 can act to control specific components of the system in concert with the one or more system controllers 30.

One or more controllers 30, 31 of the heat pump system 100 can be configured to monitor input sensors (e.g., with the input module) to determine the appropriate control actions that should be taken based on the actual, real-time, system operating conditions. For example, one or more controllers 30, 31 can be disposed in operable communication with a compressor inlet temperature sensor 47, a compressor inlet pressure sensor 48, a compressor outlet temperature sensor 52, a compressor outlet pressure sensor 53, a compressor differential pressure sensor 54, an indoor air supply temperature sensor 21, an indoor air return temperature sensor 29, and outdoor air temperature sensor 61, a compressor outlet high pressure switch 55, or a combination including at least one of the foregoing. Further, the one or more controllers 30, 31 can include memory for storing data. Such stored data can include refrigerant thermodynamic properties, relationships, tables or other physical or computational data (e.g., threshold values, calculational constants, and the like) used by the one or more controllers 30, 31 to interpret data from sensors of the heat pump system 100.

One or more controllers 30, 31 of the heat pump system 100 can be configured to calculate parameters from the input sensors such that additional control determinations can be made. For example, the one or more controllers 30, 31 can utilize a known relationship between the pressure of the refrigerant and its saturation temperature (e.g., programmed into the memory of the controller, such as non-volatile memory) to determine the superheat level of the refrigerant at various locations throughout the refrigerant cycle (e.g., at the compressor inlet 49).

The heat pump system 100 can be configured to operate in a cooling mode where vapor phase refrigerant flowing out of the compressor 50 is cooled in the outdoor heat exchanger 60 (acting as a condenser), expanded to lower pressure through the expansion valve 80, and delivered as a cold fluid to the indoor heat exchanger 20 (acting as an evaporator). Once the refrigerant absorbs thermal energy from the indoor airflow 28 flowing across the indoor heat exchanger 20 it returns to the compressor 50 in vapor phase (e.g., superheated vapor).

In the cooling mode the four-way valve 40 can be moved to a first position 45 (e.g., as in detail A of FIG. 1) where refrigerant can be flowed sequentially through the closed fluid circuit 2 along a cooling mode flowpath from the compressor 50, through a first circuit 41 of the four-way valve 40, the outdoor heat exchanger 60, the expansion valve 80, the indoor heat exchanger 20, a second circuit 42 of the four-way valve 40, and back to the compressor 50. The refrigerant flow direction during cooling mode is indicated by cooling mode directional arrows 4 and mode independent directional arrows 7 which are unaffected by the position of the four-way valve 40. In this mode thermal energy is absorbed in the indoor heat exchanger 20, thereby cooling the indoor airflow 28, and thermal energy is released in the outdoor heat exchanger 60, thereby heating the outdoor air.

The heat pump system 100 can be configured to operate in a heating mode where vapor phase refrigerant flowing out of the compressor 50 is cooled in the indoor heat exchanger 20 (acting as a condenser), expanded to lower pressure through the expansion valve 80, and delivered as a cold fluid to the outdoor heat exchanger 60 (acting as an evaporator). Once the refrigerant absorbs thermal energy in the outdoor heat exchanger 60 it returns to the compressor 50 in vapor phase.

In the heating mode the four-way valve can be moved to a second position 46 (e.g., as in detail A of FIG. 1) where refrigerant can be flowed sequentially through the closed fluid circuit 2 along a heating mode flowpath from the compressor 50, through a third circuit 43 of the four-way valve 40, the indoor heat exchanger 20, the expansion valve 80, the outdoor heat exchanger 60, a fourth circuit 44 of the four-way valve 40, and back to the compressor 50. The refrigerant flow direction during heating mode is indicated by heating mode directional arrows 5 and mode independent directional arrows 7 which are unaffected by the position of the four-way valve 40. In this mode thermal energy is absorbed in the outdoor heat exchanger 60, thereby cooling the outdoor fluid flow 68 (e.g., air urged by fan or blower 67, or heat transfer fluid associated with a geothermal heat pump), and thermal energy is released in the indoor heat exchanger 60, thereby heating the indoor airflow 28 flowing across the indoor heat exchanger 20.

An operational challenge which can arise in heat pump systems 100 occurs when the indoor heat exchanger 20 and the outdoor heat exchanger 60 have unequal fluid volume capacities. For example, this can occur by design (e.g., in high efficiency heat pump systems 100 where larger heat exchangers, particularly outdoor heat exchangers, are utilized to increase overall system efficiency), can result from difference in indoor and outdoor spatial constraints (e.g., the former usually more prescriptive than the latter), can be the result of field modifications (e.g., retrofitting of a heat exchanger into an existing heat pump system 100). In any scenario, a volume capacity difference between the indoor heat exchanger 20 and the outdoor heat exchanger 60 can contribute to an imbalance of refrigerant charge within the heat pump system 100. Such volume capacity difference can further exacerbate charge imbalance during system operation due to differences in the amount of refrigerant charge needed for cooling operation versus heating operation. For example, heat pump systems 100 can be initially charged according to cooling load requirements which can result in excess charge when the heat pump system 100 is operated in the heating mode.

An important parameter of heat pump system 100 operation can include the compression ratio of the compressor 50 which can be defined as the absolute outlet pressure of the compressor divided by absolute inlet pressure. However, as a result of this charge imbalance during heating mode operation, an accumulation of charge can develop in the indoor heat exchanger 20 which can lead to high compression ratio across the compressor 50 and/or high discharge pressure at the outlet of the compressor 50 (e.g., as measured by the compressor inlet pressure sensor 48, the compressor outlet pressure sensor 52, the compressor differential pressure sensor 54, or a combination including at least one of the foregoing). Ultimately, when such an imbalance situation arises, the heat pump system 100 can be forced to shut down or operate at reduced capacity until the imbalance is resolved which can result in customer inconvenience from system downtime and/or performance disruption. To avoid such situations, the inventors have developed methods of control for heat pump systems 100 that are capable of controlling operation during charge imbalance scenarios to avoid system interruptions or capacity reductions.

FIGS. 2-5 include schematic illustrations of a method of operating the heat pump system 100. The method can include operating the heat pump system 100 in a demand operation heating mode 210 with the one or more controllers 30, 31. The demand operation heating mode 210 can include flowing refrigerant sequentially through the refrigerant cycle from the compressor 50 through the indoor heat exchanger 20, the expansion valve 80, and the outdoor heat exchanger 60 before returning to the compressor 50. For example, in the demand operation heating mode 210 the four-way valve 40 can be disposed in the second position 46 such that refrigerant flows along the third circuit of the four-way valve from the outlet 51 of the compressor 50 to the indoor heat exchanger 20, and flows along the fourth circuit of the four-way valve 40 from the outdoor heat exchanger 60 to the inlet 49 of the compressor 50.

The demand operation heating mode 210 can include controlling with the one or more controllers 30, 31 an opening amount of the expansion valve 80 based on a superheat difference between a compressor inlet superheat value and a target compressor inlet superheat value. The compressor inlet superheat value can be based on the compressor inlet temperature sensor 47, the compressor inlet pressure sensor 48, and thermodynamic property data for the refrigerant (e.g., stored in memory of the one or more controllers 30, 31). For example, the target compressor inlet superheat value can be from about 1° F. to about 25° F., or from about 1° F. to about 20° F., or from about 1° F. to about 15° F., or from about 1° F. to about 10° F., or from about 2° F. to about 10° F., or about 3° F. to about 10° F., or from about 3° F. to about 9° F., or from about 3° F. to about 8° F., or about 1° F., or about 2° F., or about 3° F., or about 4° F., or about 5° F., or about 6° F., or about 7° F., or about 8° F., or about 9° F., or about 10° F., or about 11° F., or about 12° F., or 13° F., or about 14° F., or about 15° F. The demand operation heating mode 210 can include controlling with the one or more controllers 30, 31 a flowrate of the refrigerant through the compressor 50 based on a thermal demand difference between a thermal output of the indoor heat exchanger 20 and a customer thermal demand. The customer thermal demand can correspond to a target indoor temperature, cooling rate, and the like. Controlling the refrigerant flowrate through the compressor 50 can include changing the frequency of an electronic drive disposed in operative communication with the compressor 50.

The demand operation heating mode 210 can include monitoring with the controller 30 a parameter of the refrigerant cycle indicative of a charge imbalance condition. Such a parameter of the refrigerant cycle can include the discharge pressure of the compressor 50 (e.g., as measured by the compressor outlet pressure sensor 53), and/or the compression ratio of the compressor 50 (e.g., as determined from the compressor outlet pressure sensor 53, the compressor inlet pressure sensor 48, the compressor differential pressure sensor 54, or a combination including at least one of the foregoing). The inventors have observed that when a charge imbalance condition begins to arise in the heat pump system 100, the discharge pressure of the compressor 50, and/or the compression ratio of the compressor 50 will increase. Left unmitigated, the refrigerant charge imbalance can prevent the one or more controllers 30, 31 from achieving the target discharge pressure and/or compression ratio (e.g., which can result in de-rated performance or a shutdown of the heat pump system 100).

The operating method can include transitioning operation with the one or more controllers 30, 31 from the demand operation heating mode 210 to a charge compensation mode 220 when the parameter satisfies a first threshold condition as indicated by reference 211. For example, the first threshold condition can include the value of the parameter being greater than or equal to a first threshold value for the duration of a first timer. The parameter can include the compressor outlet pressure (e.g., as measured by the compressor outlet pressure sensor 53) and the first threshold value can be a gauge pressure from about 400 pounds per square inch gauge (psig) to about 600 psig. Alternatively, the parameter can include the compression ratio of the compressor 50 and the first threshold value can be a ratio from about 1 to about 15, or from about 2 to about 10, or from about 3 to about 9, or from about 4 to about 8, or from about 5 to about 8, or about 5, or about 6, or about 7, or about 8. The first timer can be set to any suitable duration, for example the first timer can have a duration of about 0 to about 60 seconds, or from about 1 to about 60 seconds, or from about 1 second to about 30 seconds, or about 0 seconds, or about 10 seconds, or about 20 seconds, or about 30 seconds, or about 60 seconds, or the like.

The charge compensation mode 220 can include performing with the one or more controllers 30, 31 a charge imbalance mitigation strategy. Such mitigation strategy can include operating the heat pump system 100 in a mitigation mode 225 followed by a recovery mode 260. The mitigation mode 225 can include performing a mitigation including an expansion valve mitigation 230, a compressor mitigation 250, or both. Further, the mitigation can include preforming the expansion valve mitigation 230 followed by the compressor mitigation 250 (as in FIGS. 2 and 5), or vice versa (as in FIGS. 3 and 4).

In some scenarios, only one of the expansion valve mitigation 230 or the compressor mitigation 250 will be performed before the parameter satisfies a second threshold condition, allowing transition from mitigation mode 225 to recovery mode 260 as indicated by reference 255. The mitigation mode 225 can include decreasing with the one or more controllers 30, 31 a target value of the parameter from an enable value of the parameter to a disable value of the parameter. For example, when the parameter is the compressor outlet pressure the parameter enable value can be from about 400 psig to about 600 psig and the parameter disable value can be from about 5 psig to about 80 psig, such as from about 10 psig to about 70 psig, or from about 20 psig to about 60 psig, below the parameter enable value. Alternatively, when the parameter is the compression ratio the parameter enable value can be about from about 1 to about 15, such as from about 2 to about 10, or from about 3 to about 9, or from about 4 to about 8, or from about 5 to about 8, or about 5, or about 6, or about 7, or about 8 and the parameter disable value can be from about 0.01 to about 1, such as about 0.05 to about 0.8, or about 0.07 to about 0.7, or about 0.1 to about 0.5, below the parameter enable value. Alternatively, the enable value can be set equal to its value of the first threshold condition, such that the controls transition smoothly (e.g., without large errors between measured variable and control targets) from demand heating operation 210 to charge compensation mode 220.

The charge compensation mode 220 can include transitioning operation with the controller from the mitigation mode 225 to the recovery mode 260 when the parameter satisfies the second threshold condition as indicated by references 233 and 255. For example, the second threshold condition can include the value of the parameter being greater than or equal to a second threshold value for the duration of a second timer. The parameter can include the compressor outlet pressure (e.g., as measured by the compressor outlet pressure sensor 53) and the second threshold value can be a gauge pressure from about 400 psig to about 600 psig. Alternatively, the parameter can include the compression ratio of the compressor 50 and the second threshold value can be a ratio from about 1 to about 15, or from about 2 to about 10, or from about 3 to about 9, or from about 4 to about 8, or from about 5 to about 8, or about 5, or about 6, or about 7, or about 8. The second timer can be set to any suitable duration, for example the second timer can have a duration of about 0 to about 60 seconds, or from about 1 to about 60 seconds, or from about 1 second to about 30 seconds, or about 0 seconds, or about 10 seconds, or about 20 seconds, or about 30 seconds, or about 60 seconds, or the like. Optionally, the second threshold condition can be the same condition as the first threshold condition, the same threshold value, and/or same timer duration.

The charge compensation mode 220 can include operating the heat pump system in the recovery mode 260 including performing a recovery including a compressor inlet superheat recovery 270 or a compressor flowrate recovery 290, or both. following the mitigation (e.g., upon exiting the mitigation mode 225). Further, the recovery can include performing the inlet superheat recovery 270 followed by the compressor flowrate recovery 290 (as in FIGS. 2 and 4), or vice versa (as in FIGS. 3 and 5).

The charge compensation mode 220 can include transitioning operation with the one or more controllers 30, 31 to the demand operation heating mode 210 when the parameter satisfies a third threshold condition as indicated by references 219 and 295. Once the mitigation and the recovery are complete a portion of the refrigerant charge will be moved from the indoor heat exchanger 20 to the outdoor heat exchanger 60 or optional accumulator 90. As a result of the charge redistribution, the parameter should return to a desired operating range (e.g., which does not satisfy the first threshold condition) and remain within its normal controlled range. As this occurs the third threshold condition can be satisfied allowing the heat pump system 100 to transition to operation in demand heating mode 210. For example, the third threshold condition can correspond to successful completion of recovery actions, such as restoring compressor inlet superheat and compressor refrigerant flowrate to their desired operating ranges without satisfying the first threshold condition. In further example, the third threshold condition can include the value of the parameter being greater than or equal to a third threshold value for the duration of a third timer. The parameter can include the compressor outlet pressure (e.g., as measured by the compressor outlet pressure sensor 53) and the third threshold value can be a gauge pressure from about 400 psig to about 600 psig. Alternatively, the parameter can include the compression ratio of the compressor 50 and the third threshold value can be a ratio from about 1 to about 15, or from about 2 to about 10, or from about 3 to about 9, or from about 4 to about 8, or from about 5 to about 8, or about 5, or about 6, or about 7, or about 8. The third timer can be set to any suitable duration, for example the third timer can have a duration of about 0 to about 60 seconds, or from about 1 to about 60 seconds, or from about 1 second to about 30 seconds, or about 0 seconds, or about 10 seconds, or about 20 seconds, or about 30 seconds, or about 60 seconds, or the like. Optionally, the third threshold condition can be the same condition as the first threshold condition, the second threshold condition, or both, including having the same threshold value, and/or same timer duration.

In some scenarios the mitigation may not resolve the charge imbalance condition sufficiently to complete the recovery process without the parameter satisfying the first threshold condition again. For example, the mitigation may not transfer sufficient volume of charge away from the outdoor heat exchanger 20 which can result to repeated high pressure at the compressor outlet 51 or high compression ratio across the compressor 50. Accordingly, the charge compensation mode 220 can include transitioning operation with the one or more controllers 30, 31 from the recovery mode 260 to the mitigation mode 225 when the parameter satisfies a fourth threshold condition as indicated by references 271 and 291. For example, the fourth threshold condition can include the value of the parameter being greater than or equal to a fourth threshold value for the duration of a fourth timer. The parameter can include the compressor outlet pressure (e.g., as measured by the compressor outlet pressure sensor 53) and the fourth threshold value can be a gauge pressure from about 400 psig to about 600 psig. Alternatively, the parameter can include the compression ratio of the compressor 50 and the fourth threshold value can be a ratio from about 1 to about 15, or from about 2 to about 10, or from about 3 to about 9, or from about 4 to about 8, or from about 5 to about 8, or about 5, or about 6, or about 7, or about 8. The fourth timer can be set to any suitable duration, for example the fourth timer can have a duration of about 0 to about 60 seconds, or from about 1 to about 60 seconds, or from about 1 second to about 30 seconds, or about 0 seconds, or about 10 seconds, or about 20 seconds, or about 30 seconds, or about 60 seconds, or the like. Optionally, the fourth threshold condition can be the same condition as the first threshold condition, the second threshold condition, the third threshold condition, or all three, including having the same threshold value, and/or same timer duration.

The expansion valve mitigation 230 can include stopping the controlling with the one or more controllers 30, 31 the opening amount of the expansion valve 80 based on the superheat difference between the compressor inlet superheat value and the target compressor inlet superheat value and controlling with the one or more controllers 30, 31 the opening amount of the expansion valve 80 based on a difference between the parameter and the target value of the parameter. The expansion valve mitigation 230 can disable the compressor inlet superheat control and instead control the opening position of the expansion valve 80 based on the parameter's distance from its target value. In this way, the method can allow the expansion valve to open as the one or more controllers 31 attempts to reach the decreasing target value of the parameter (e.g., decreasing from the enable value to the disable value upon entering the mitigation mode 225). As the expansion valve 80 opens more and more if the parameter remains distant from target it will eventually reach a fully open position.

The compressor mitigation 250 can include stopping the controlling with the one or more controllers 30, 31 the flowrate of the refrigerant through the compressor 50 based on the thermal demand difference between the thermal output of the indoor heat exchanger 20 and the customer thermal demand, maintaining the opening amount of the expansion valve 80; and controlling with the one or more controllers 30, 31 the flowrate of the refrigerant through the compressor 50 based on the difference between the parameter and the target value of the parameter. Alternatively, instead of maintaining the opening amount of the expansion valve 80, the compressor mitigation 250 can include adjusting the opening position of the expansion valve 80. For example, the expansion valve 80 can be opened or closed an additional amount of about 0.1% to about 10%, or about 0.1% to about 5%, or about 0.1% to about 3%, or about 0.1% to about 2%, or about 1% to about 10%, or about 1% to about 5%, or about 1% to about 3%, or about 1% to about 2%. In an embodiment the expansion valve can be opened to a greater opening amount, such as a substantially open position equal to greater than 50% open, or about greater than or equal to about 75%, or greater than or equal to about 80%, or greater than or equal to about 90%, or greater than or equal to about 95%, or greater than or equal to about 99% of its full open position, or to its fully open position.

The compressor mitigation 250 can disable the customer thermal demand control and instead control the flowrate of refrigerant through the compressor 50 based on the parameter's distance from its target value. In this way, the method can allow the heat pump system 100 to operate at reduced thermal output as the one or more controllers 30, 31 attempt to reach the decreasing target value of the parameter (e.g., decreasing from the enable value of the parameter to the disable value of the parameter upon entering the mitigation mode 225). As the flowrate of refrigerant through the compressor 50 is reduced if the parameter remains distant from target it will eventually reach a low flow condition. The method of can include controlling the flowrate of refrigerant through the compressor 50 by controlling the speed of the compressor 50 (e.g., via a variable frequency drive). Alternatively, a combination of one or more bypass valves and/or one or more compressors (e.g., having discrete speed settings) could be used to control the flowrate of refrigerant through the compressor 50 which remains within the scope of the present disclosure. In systems where more than one compressor 50 is used the same method can be applied. In such instances the flowrate of refrigerant through the compressor 50 would equate to the total flowrate of refrigerant through the plurality of compressors.

The compressor inlet superheat recovery 270 can include stopping the controlling with the one or more controllers 30, 31 the flowrate of refrigerant through the compressor 50 based on the difference between the parameter and the target value of the parameter, maintaining a substantially constant flowrate of the refrigerant through the compressor 50 and controlling with the one or more controllers 30, 31 the opening amount of the expansion valve 80 based on a superheat difference between a compressor inlet superheat value and the target compressor inlet superheat value. The compressor inlet superheat recovery 270 can allow the heat pump system 100 to begin a return to demand heating mode 210 by first trying to regain control of the compressor inlet superheat using the expansion valve 80. Maintaining a substantially constant flowrate of refrigerant through the compressor 50, the control basis for the expansion valve 80 is returned to the compressor inlet superheat value in an attempt to track the target compressor inlet superheat value. If the mitigation performed in the mitigation mode 225 was sufficient, then the expansion valve 80 will be able to regain control of the compressor inlet superheat value and the parameter will remain within an acceptable region for operation in recovery mode 260.

The compressor flowrate recovery 290 can include increasing with the one or more controllers 30, 31 the flowrate of the refrigerant through the compressor 50 until the flowrate reaches a target flowrate value. The target flowrate value can be determined by the customer thermal demand. Increasing the flowrate of refrigerant can be done in any suitable fashion. For example, when a variable frequency drive is used the frequency can be modulated to increase the compressor speed. The increase in flowrate can be controlled in a linear ramp from the refrigerant flowrate upon beginning the compressor flow rate recovery 290 to the target flow rate value along a constant rate. For example, the recovery rate can be from about 0.5 revolutions per minute per second (rpm/s) to about 25 rpm/s, such as about 0.5 rpm/s to about 15 rpm/s, or from about 0.5 rpm/s to about 10 rpm/s, or from about 1 rpm/s to about 10 rpm/s, or from about 1 rpm/s to about 5 rpm/s. By maintaining a constant rate of increase of the refrigerant flowrate it has been observed that the heat pump system 100 is able to gradually return to demand heating operation 210.

The inventors have determined that the order of operations within each the mitigation mode 225 and the recovery mode 260 is inconsequential to the ultimate recovery of the heat pump system 100 operation after experiencing a charge imbalance scenario. Accordingly, the compressor mitigation 250 can precede the expansion valve mitigation 230 as in FIGS. 3-4, or vice versa as in FIGS. 2 and 5, and the compressor flowrate recovery 290 can precede the compressor inlet superheat recovery 270 as in FIGS. 3 and 5, or vice versa as in FIGS. 2 and 4. Accordingly, the method can include a number of transitions between the disclosed states of operation. The method can include transitioning operation with the one or more controllers 30, 31 from the expansion valve mitigation 230 to the compressor mitigation 250 when the opening position of the expansion valve 80 reaches a fully open position. The method can include transitioning operation with the one or more controllers 30, 31 from the compressor mitigation 250 to the expansion valve mitigation 230 when the flowrate of refrigerant through the compressor 50 reaches a minimum flowrate value. The minimum flowrate value can be based on the maximum flowrate or maximum speed of the compressor 50, e.g., the minimum flowrate can be set to a percentage of the maximum flowrate or speed, such as between about 10% and about 50% of the maximum operating flowrate or speed, or from about 10% to about 40%, or from about 10% to about 30%, or from about 10% to about 25%, or about 25%, or about 20%, or about 15%, or about 10% of the maximum operating flowrate or speed. Alternatively, the method can include transitioning operation with the one or more controllers 30, 31 from the compressor mitigation 250 to the expansion valve mitigation 230 when the speed of the compressor 50 reaches a minimum speed (e.g., such as previously described).

The method can include transitioning operation with the one or more controllers 30, 31 from the mitigation mode 225 to the compressor inlet superheat recovery 270 or to the compressor flowrate recovery 290 when the parameter reaches the target value of the parameter. For example, when the mitigation is successful and the second threshold condition is satisfied, operation can transition from the mitigation mode 225 to the recovery mode 260. Upon transitioning to recovery mode 260 the recovery can begin with either the inlet superheat recovery 270 or the compressor flowrate recovery 290.

The method can include transitioning operation with the one or more controllers 30, 31 from the compressor inlet superheat recovery 270 to the compressor flowrate recovery 290 when the compressor inlet superheat value reaches the target compressor inlet superheat value. The method can also include transitioning operation with the one or more controllers 30, 31 from the compressor flowrate recovery 290 to the compressor inlet superheat recovery 270 when the flowrate of refrigerant through the compressor 50 reaches a target flowrate. The target refrigerant flowrate can be based on the customer thermal demand of the heat pump system 100.

In the recovery mode 260, the one or more controllers 30, 31 can gradually transition the controls back to controls methods of the demand heating operation 210. In some instances, if redistribution of refrigerant charge has been insufficient in the mitigation mode 225, the controller will revert to the mitigation mode 225 until sufficient redistribution has occurred. In these cases, the one or more controllers 30, 31 can be configured for transitioning operation from the recovery mode 260 to the expansion valve mitigation 230 or to the compressor mitigation 250 when the parameter satisfies the first threshold condition.

As previously described, in the mitigation mode 225, the one or more controllers 30, 31 can attempt to regain control of the compressor discharge pressure or the compression ratio by dismissing the customer thermal demand and/or the inlet superheat controls. However, because both approaches are disfavored during normal operation, the one or more controllers 30, 31 can look to transition out of the mitigation mode 225 at the earliest opportunity. Accordingly, the method can include transitioning operation with the one or more controllers 30, 31 from the expansion valve mitigation 230, or from the compressor flowrate mitigation 250, to the recovery mode 260 when the parameter satisfies the second threshold condition.

As previously described, in the recovery mode 260, the one or more controllers 30, 31 can attempt to return to normal operating mode by regaining control of the compressor inlet superheat with the expansion valve 80 and regaining control of the customer thermal demand with the refrigerant flowrate through the compressor. However, in some scenarios the transitions may occur before sufficient redistribution of refrigerant charge occurs. In such cases, even after mitigations are complete the system can return to a charge imbalance condition. As a result, the controller 30 can be configured for transitioning operation from the compressor inlet superheat recovery 270 or from the from the compressor flowrate recovery to the mitigation mode 225 when the parameter satisfies the first threshold condition.

In a first aspect, a method of operating a heat pump system can include: operating the heat pump system in a demand operation heating mode with a controller wherein a refrigerant flows through a refrigerant cycle from a compressor through an indoor heat exchanger, an expansion valve, and an outdoor heat exchanger before returning to the compressor, and wherein the demand operation heating mode includes controlling with the controller an opening amount of the expansion valve based on a superheat difference between a compressor inlet superheat value and a target compressor inlet superheat value, and controlling with the controller a flowrate of the refrigerant through the compressor based on a thermal demand difference between a thermal output of the indoor heat exchanger and a customer thermal demand; monitoring with the controller a parameter of the refrigerant cycle indicative of a charge imbalance condition; and transitioning operation with the controller to a charge compensation mode when the parameter satisfies a first threshold condition, wherein the charge compensation mode includes performing a charge imbalance mitigation strategy.

The method of operating a heat pump system according to the first aspect can include, wherein the performing the charge imbalance mitigation strategy includes operating an expansion valve mitigation including: stopping the controlling with the controller the opening amount of the expansion valve based on the superheat difference between the compressor inlet superheat value and the target compressor inlet superheat value; decreasing with the controller a target value of the parameter from the enable value of the parameter to the disable value of the parameter; and controlling with the controller the opening amount of the expansion valve based on a difference between the parameter and the target value of the parameter.

The method of operating a heat pump system according to the first aspect further including, wherein the charge imbalance mitigation strategy further includes a compressor mitigation including: transitioning operation with the controller to the compressor mitigation after the target value of the parameter reaches the disable value, the opening position of the expansion valve reaches a substantially open position, or a predetermined opening amount; stopping the controlling with the controller the flowrate of the refrigerant through the compressor based on the thermal demand difference between the thermal output of the indoor heat exchanger and the customer thermal demand; maintaining the opening amount of the expansion valve; and controlling with the controller the flowrate of the refrigerant through the compressor based on the difference between the parameter and the target value of the parameter.

The method of operating a heat pump system according to the first aspect further including, wherein the charge imbalance mitigation strategy further includes a compressor inlet superheat recovery comprising: transitioning operation with the controller to the compressor inlet superheat recovery after the parameter reaches the target value of the parameter; maintaining a substantially constant flowrate of the refrigerant through the compressor; and controlling with the controller the opening amount of the expansion valve based on a superheat difference between a compressor inlet superheat value and a target compressor inlet superheat value.

The method of operating a heat pump system according to the first aspect further including, wherein the charge imbalance mitigation strategy further includes a compressor flowrate recovery comprising: transitioning operation with the controller to the compressor flowrate recovery after the parameter reaches the target value of the parameter; increasing with the controller the flowrate of the refrigerant through the compressor until the flowrate reaches a target flowrate value.

The method of operating a heat pump system according to the first aspect further including, transitioning operation with the controller from the expansion valve mitigation to the demand operation heating mode when the parameter satisfies the first threshold condition.

The method of operating a heat pump system 100 according to the first aspect further including, transitioning operation with the one or more controllers 30, 31 from the compressor inlet superheat recovery to the expansion valve mitigation when the parameter satisfies the second threshold condition.

The method of operating a heat pump system according to the first aspect further including, transitioning from the compressor flowrate recovery 290 to the expansion valve mitigation 230 when the parameter satisfies a fifth threshold condition. For example, the fifth threshold condition can include the value of the parameter being greater than or equal to a fifth threshold value for the duration of a fifth timer. The parameter can include the compressor outlet pressure (e.g., as measured by the compressor outlet pressure sensor 53) and the fifth threshold value can be a gauge pressure from about 400 psig to about 600 psig. Alternatively, the parameter can include the compression ratio of the compressor 50 and the fifth threshold value can be a ratio from about 1 to about 15, or from about 2 to about 10, or from about 3 to about 9, or from about 4 to about 8, or from about 5 to about 8, or about 5, or about 6, or about 7, or about 8. The fifth timer can be set to any suitable duration, for example the fifth timer can have a duration of about 0 to about 60 seconds, or from about 1 to about 60 seconds, or from about 1 second to about 30 seconds, or about 0 seconds, or about 10 seconds, or about 20 seconds, or about 30 seconds, or about 60 seconds, or the like. Optionally, the fifth threshold condition can be the same condition as the first threshold condition, the second threshold condition, the third threshold condition, the fourth threshold condition, or all four, including having the same threshold value, and/or same timer duration.

The method of operating a heat pump system according to the first aspect further including, transitioning from the compressor flowrate recovery 290 to the demand operation heating 210 when the parameter satisfies the third threshold condition.

The method of operating a heat pump system according to the first aspect further including, transitioning from the expansion valve mitigation 230 to the compressor inlet superheat recovery when the parameter satisfies a sixth threshold condition. For example, the sixth threshold condition can include the value of the parameter being greater than or equal to a sixth threshold value for the duration of a sixth timer. The parameter can include the compressor outlet pressure (e.g., as measured by the compressor outlet pressure sensor 53) and the sixth threshold value can be a gauge pressure from about 400 psig to about 600 psig. Alternatively, the parameter can include the compression ratio of the compressor 50 and the sixth threshold value can be a ratio from about 1 to about 15, or from about 2 to about 10, or from about 3 to about 9, or from about 4 to about 8, or from about 5 to about 8, or about 5, or about 6, or about 7, or about 8. The sixth timer can be set to any suitable duration, for example the sixth timer can have a duration of about 0 to about 60 seconds, or from about 1 to about 60 seconds, or from about 1 second to about 30 seconds, or about 0 seconds, or about 10 seconds, or about 20 seconds, or about 30 seconds, or about 60 seconds, or the like. Optionally, the sixth threshold condition can be the same condition as the first threshold condition, the second threshold condition, the third threshold condition, the fourth threshold condition, the fifth threshold condition, or all five, including having the same threshold value, and/or same timer duration.

The method of operating a heat pump system as in any one of the preceding aspects, wherein the parameter includes a compressor discharge pressure, a compressor compression ratio, or a combination comprising at least one of the foregoing.

The heat pump system 100 can optionally include a separator 90 (e.g., providing a reduced velocity liquid drop-out zone) for preventing liquid phase refrigerant from entering the inlet of the compressor 50.

The heat pump system 100 can optionally include a pressure equalization valve 59 for equilibrating the fluid pressure between the compressor inlet and compressor outlet during, and/or after a system shutdown event. For example, during normal operation of the heat pump system 100, the pressure equalization valve 59 can be closed such that negligible or no refrigerant flows through the valve. During a shutdown event of the heat pump system 100 the one or more controllers 30, 31 can open the pressure equalization valve 59 such that higher pressure refrigerant present at the compressor outlet is allowed to flow into the lower pressure compressor inlet along flowpath 9.

Controlling can include situations where the physical conditions of the refrigerant cycle prevent the controlled parameter from achieving the target value of the controlled parameter. In such situations, the controlled parameter can still be considered "controlled" because the controller remains actively engaged in trying to bring the value to the target value even though the physical conditions prevent it.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method of operating a heat pump system comprising:

operating the heat pump system in a demand operation heating mode with one or more controllers wherein a refrigerant flows through a refrigerant cycle from a compressor through an indoor heat exchanger, an expansion valve, and an outdoor heat exchanger before returning to the compressor, and wherein the demand operation heating mode comprises controlling with the one or more controllers an opening amount of the expansion valve based on a superheat difference between a compressor inlet superheat value and a target compressor inlet superheat value, and controlling with the one or more controllers a flowrate of the refrigerant through the compressor based on a thermal demand difference between a thermal output of the indoor heat exchanger and a customer thermal demand;

monitoring with the one or more controllers a parameter of the refrigerant cycle indicative of a charge imbalance condition; and transitioning operation with the one or more controllers to a charge compensation mode when the parameter satisfies a first threshold condition, wherein the charge compensation mode comprises:

operating the heat pump system in a mitigation mode, the mitigation mode comprising decreasing a target value of the parameter from an enable value of the parameter to a disable value of the parameter;

transitioning operation with the one or more controllers from the mitigation mode to a recovery mode when the parameter satisfies a second threshold condition; and transitioning operation with the one or more controllers to the demand operation heating mode when the parameter satisfies a third threshold condition.

2. The method of operating the heat pump system of claim 1, wherein the mitigation mode comprises:

at least one of an expansion valve mitigation, or a compressor mitigation, and wherein the recovery mode comprises at least one of a compressor inlet superheat recovery or a compressor flowrate recovery following the mitigation.

3. The method of operating the heat pump system of claim 1, further comprising:

transitioning operation with the one or more controllers from the recovery mode to the mitigation mode when the parameter satisfies a fourth threshold condition.

4. The method of operating the heat pump system of claim 2, wherein the expansion valve mitigation comprises:

stopping the controlling with the one or more controllers the opening amount of the expansion valve based on the superheat difference between the compressor inlet superheat value and the target compressor inlet superheat value; and controlling with the one or more controllers the opening amount of the expansion valve based on a difference between the parameter and the target value of the parameter.

5. The method of operating the heat pump system of claim 2, wherein the compressor mitigation comprises:

stopping the controlling with the one or more controllers the flowrate of the refrigerant through the compressor based on the thermal demand difference between the thermal output of the indoor heat exchanger and the customer thermal demand;

maintaining the opening amount of the expansion valve; and controlling with the one or more controllers the flowrate of the refrigerant through the compressor based on the difference between the parameter and the target value of the parameter.

6. The method of operating the heat pump system of claim 2, wherein the compressor inlet superheat recovery comprises:

stopping the controlling with the one or more controllers the flowrate of refrigerant through the compressor based on the difference between the parameter and the target value of the parameter;

maintaining a substantially constant flowrate of the refrigerant through the compressor; and controlling with the one or more controllers the opening amount of the expansion valve based on a superheat difference between a compressor inlet superheat value and a target compressor inlet superheat value.

7. The method of operating the heat pump system of claim 2, wherein the compressor flowrate recovery comprises:

increasing with the one or more controllers the flowrate of the refrigerant through the compressor until the flowrate reaches a target flowrate value.

8. The method of operating the heat pump system of claim 2, further comprising:

transitioning operation with the one or more controllers from the expansion valve mitigation to the compressor mitigation when the opening position of the expansion valve reaches a fully open position.

9. The method of operating the heat pump system of claim 2, further comprising:

transitioning operation with the one or more controllers from the compressor mitigation to the expansion valve mitigation when the flowrate of refrigerant through the compressor reaches a minimum flowrate value.

10. The method of operating the heat pump system of claim 2, further comprising:

transitioning operation with the one or more controllers from the mitigation mode to the compressor inlet superheat recovery when the parameter reaches the target value of the parameter.

11. The method of operating the heat pump system of claim 2, further comprising:

transitioning operation with the one or more controllers from the mitigation mode to the compressor flowrate recovery when the parameter reaches the target value of the parameter.

12. The method of operating the heat pump system of claim 2, further comprising:

transitioning operation with the one or more controllers from the compressor inlet superheat recovery to the compressor flowrate recovery when the compressor inlet superheat value reaches the target compressor inlet superheat value.

13. The method of operating the heat pump system of claim 2, further comprising:

transitioning operation with the one or more controllers from the compressor flowrate recovery to the compressor inlet superheat recovery when the compressor speed reaches a full speed threshold.

14. The method of operating the heat pump system of claim 2, further comprising:

transitioning operation with the one or more controllers from the recovery mode to the expansion valve mitigation when the parameter satisfies the first threshold condition.

15. The method of operating the heat pump system of claim 2, further comprising:

transitioning operation with the one or more controllers from the recovery mode to the compressor mitigation when the parameter satisfies the first threshold condition.

16. The method of operating the heat pump system of claim 2, further comprising:

transitioning operation with the one or more controllers from the expansion valve mitigation to the recovery mode when the parameter satisfies the second threshold condition.

17. The method of operating the heat pump system of claim 2, further comprising:

transitioning operation with the one or more controllers from the compressor flowrate mitigation to the recovery mode when the parameter satisfies the second threshold condition.

18. The method of operating the heat pump system of claim 2, further comprising:

transitioning operation with the one or more controllers from the compressor inlet superheat recovery to the mitigation mode when the parameter satisfies the first threshold condition.

19. The method of operating the heat pump system of claim 2, further comprising:

transitioning operation with the one or more controllers from the compressor flowrate recovery to the mitigation mode when the parameter satisfies the first threshold condition.

* * * * *